US008384470B2

(12) United States Patent
Sugiura

(10) Patent No.: US 8,384,470 B2
(45) Date of Patent: Feb. 26, 2013

(54) INTERNAL POWER SUPPLY VOLTAGE GENERATION CIRCUIT

(75) Inventor: Masakazu Sugiura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 173 days.

(21) Appl. No.: 13/071,039

(22) Filed: Mar. 24, 2011

(65) Prior Publication Data

US 2011/0234309 A1 Sep. 29, 2011

(30) Foreign Application Priority Data

Mar. 29, 2010 (JP) ..... 2010-076378

(51) Int. Cl.
*G05F 1/10* (2006.01)

(52) U.S. Cl. ..... 327/541

(58) Field of Classification Search ..... 327/534, 327/535, 537, 538, 540, 541, 543
See application file for complete search history.

(56) References Cited

U.S. PATENT DOCUMENTS 6,147,550 A * 11/2000 Holloway ..... 327/544
6,496,056 B1 * 12/2002 Shoji ..... 327/543
7,719,346 B2 * 5/2010 Imura ..... 327/538
7,808,308 B2 * 10/2010 Lai et al. ..... 327/541
7,843,253 B2 * 11/2010 Aota et al. ..... 327/538

FOREIGN PATENT DOCUMENTS

JP 08-018339 A 1/1996

* cited by examiner

*Primary Examiner* — Jeffrey Zweizig
(74) *Attorney, Agent, or Firm* — Brinks Hofer Gilson & Lione

(57) ABSTRACT

Provided is an internal power supply voltage generation circuit with which a through current of a logic circuit supplied with an internal power supply voltage does not depend on a power supply voltage. A reference voltage (VREF) is generated based on a constant current of a current source (1) independently of a power supply voltage (VDD). Based on the reference voltage (VREF), an internal power supply voltage (DVDD) is generated independently of the power supply voltage (VDD) because of a source follower. A through current of a logic circuit (9) flows based on the internal power supply voltage (DVDD). The through current of the logic circuit (9) is therefore independent of the power supply voltage (VDD). The internal power supply voltage (DVDD) is a minimum power supply voltage for the logic circuit (9) to operate based on the specification. The through current of the logic circuit (9) is therefore small.

10 Claims, 2 Drawing Sheets

INTERNAL POWER SUPPLY VOLTAGE GENERATION CIRCUIT

RELATED APPLICATIONS

This application claims priority under 35 U.S.C. §119 to Japanese Patent Application No. 2010-076378 filed on Mar. 29, 2010, the entire content of which is hereby incorporated by reference.

BACKGROUND OF THE INVENTION

1. Field of the Invention

The present invention relates to an internal power supply voltage generation circuit for generating an internal power supply voltage at an internal power supply terminal and supplying the internal power supply voltage to a logic circuit.

2. Description of the Related Art

A conventional internal power supply voltage generation circuit is described. FIG. 4 is a circuit diagram illustrating the conventional internal power supply voltage generation circuit.

A diode-connected NMOS transistor 11 decreases a power supply voltage VDD to an internal power supply voltage DVDD. With the internal power supply voltage DVDD and a ground voltage VSS, a logic circuit 12 operates. A power supply voltage for the logic circuit 12 is decreased from the power supply voltage VDD to the internal power supply voltage DVDD, and a through current of the logic circuit 12 is reduced correspondingly (see, for example, Japanese Patent Application Laid-open No. Hei 08-018339).

In the conventional technology, however, when the power supply voltage VDD varies and increases, the internal power supply voltage DVDD also increases. Accompanying the increase in the internal power supply voltage DVDD as the power supply voltage for the logic circuit 12, the through current of the logic circuit 12 increases as well. In other words, the through current of the logic circuit 12 supplied with the internal power supply voltage DVDD depends on the power supply voltage VDD.

SUMMARY OF THE INVENTION

The present invention has been made in view of the above-mentioned problem, and provides an internal power supply voltage generation circuit with which a through current of a logic circuit supplied with an internal power supply voltage does not depend on a power supply voltage.

In order to solve the above-mentioned problem, the present invention provides an internal power supply voltage generation circuit for generating an internal power supply voltage at an internal power supply terminal and supplying the internal power supply voltage to a logic circuit, the internal power supply voltage generation circuit including: a voltage generation circuit including a PMOS transistor which is diode-connected and a first NMOS transistor which is diode-connected; a current source provided between a power supply terminal and the voltage generation circuit; and a second NMOS transistor which is source-follower-connected between the power supply terminal and the internal power supply terminal, including a gate connected to a connection node between the current source and the voltage generation circuit and supplied with a reference voltage, in which the PMOS transistor is formed by the same manufacturing process as a manufacturing process of a PMOS transistor included in the logic circuit, and the first NMOS transistor is formed by the same manufacturing process as a manufacturing process of an NMOS transistor included in the logic circuit.

According to the present invention, the reference voltage is generated based on a constant current of the current source independently of the power supply voltage, and, based on the reference voltage, the internal power supply voltage is generated independently of the power supply voltage because of the source follower. The through current of the logic circuit flows based on the internal power supply voltage. The through current of the logic circuit is therefore independent of the power supply voltage.

Further, the internal power supply voltage is a minimum power supply voltage for the logic circuit to operate based on the specification. The through current of the logic circuit is therefore small.

DETAILED DESCRIPTION OF THE PREFERRED EMBODIMENT

Referring to the accompanying drawings, an embodiment of the present invention is described below.

Figure 1:
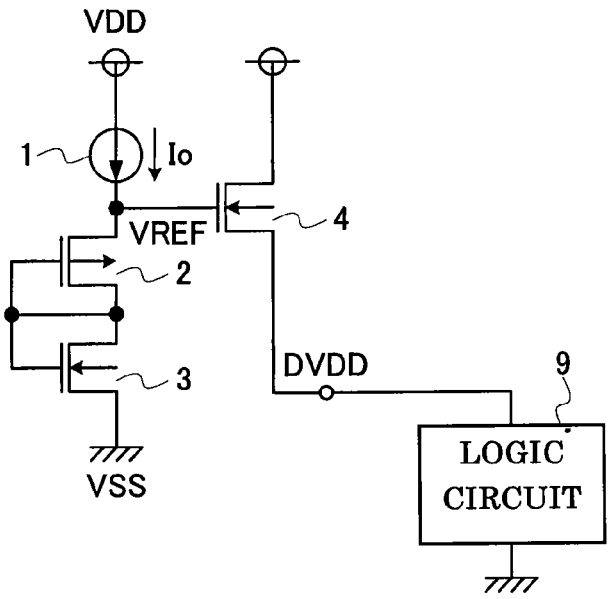
FIG. 1 is a circuit diagram illustrating an internal power supply voltage generation circuit according to the present invention.

First, a configuration of an internal power supply voltage generation circuit is described. FIG. 1 is a circuit diagram illustrating the internal power supply voltage generation circuit.

The internal power supply voltage generation circuit includes a current source 1, a PMOS transistor 2, and NMOS transistors 3 and 4. The internal power supply voltage generation circuit further includes a power supply terminal, a ground terminal, and an internal power supply terminal. The PMOS transistor 2 and the NMOS transistor 3 together form a voltage generation circuit. The NMOS transistor 4 forms a source follower.

The current source 1, the diode-connected PMOS transistor 2, and the diode-connected NMOS transistor 3 are connected in series between the power supply terminal and the ground terminal in the stated order. The NMOS transistor 4 has a gate connected to a connection node between the current source 1 and the PMOS transistor 2, a source connected to the internal power supply terminal, and a drain connected to the power supply terminal. In other words, the NMOS transistor 4 is source-follower-connected between the power supply terminal and the internal power supply terminal, with the gate connected to the connection node between the current source 1 and the PMOS transistor 2. A logic circuit 9 is provided between the internal power supply terminal and the ground terminal.

The PMOS transistor 2 is formed by the same manufacturing process as that of a PMOS transistor (not shown) included in the logic circuit 9. The NMOS transistors 3 and 4 are formed by the same manufacturing process as that of an NMOS transistor (not shown) included in the logic circuit 9.

The PMOS transistor 2 is an enhancement mode PMOS transistor having a negative threshold voltage (−Vtp2) equal to a threshold voltage of the PMOS transistor included in the logic circuit 9. The NMOS transistor 3 is an enhancement mode NMOS transistor having a positive threshold voltage Vtn3 equal to a threshold voltage of the NMOS transistor included in the logic circuit 9. The NMOS transistor 4 is an enhancement mode NMOS transistor having a positive threshold voltage Vtn4 equal to the threshold voltage of the NMOS transistor included in the logic circuit 9.

Next, an operation of the internal power supply voltage generation circuit is described.

The PMOS transistor 2 and the NMOS transistor 3 are each diode-connected. In other words, those transistors are ON. The current source 1 supplies a constant current Io to the ground terminal via the PMOS transistor 2 and the NMOS transistor 3. Based on the constant current Io and ON-state resistances of the PMOS transistor 2 and the NMOS transistor 3, a reference voltage VREF is generated at the gate of the NMOS transistor 4. In other words, the voltage generation circuit formed of the PMOS transistor 2 and the NMOS transistor 3 generates the reference voltage VREF. When the PMOS transistor 2 has an overdrive voltage Vop2 and the NMOS transistor 3 has an overdrive voltage Von3, the reference voltage VREF is calculated by Expression (1) below.

$$VREF=(|Vtp2|+Vtn3)+(Vop2+Von3) \quad (1)$$

The NMOS transistor 4 is source-follower-connected. Accordingly, an internal power supply voltage DVDD, which is a source voltage of the NMOS transistor 4, is determined based on the reference voltage VREF as a gate voltage thereof. On this occasion, appropriate circuit design is made on the drivability of the NMOS transistor 4 based on the specification of the logic circuit 9. The internal power supply voltage DVDD is a minimum power supply voltage for the logic circuit 9 to operate based on the specification. The internal power supply voltage DVDD is calculated by Expression (2) below.

$$DVDD=VREF-Vtn4=(|Vtp2|+Vtn3)+(Vop2+Von3)-Vtn4 \quad (2)$$

In this case, the constant current Io is regarded as a through current IA flowing through the turned-ON PMOS transistor 2 and the turned-ON NMOS transistor 3. Further, both the PMOS transistor and the NMOS transistor included in the logic circuit 9 may be turned ON, and those transistors may cause a through current IB to flow.

In those through currents IA and IB, the reference voltage VREF in Expression (1) is generated based on the through current IA and the ON-state resistances of the PMOS transistor 2 and the NMOS transistor 3. Based on the reference voltage VREF, the internal power supply voltage DVDD in Expression (2) is generated. The through current IB flows based on the internal power supply voltage DVDD and ON-state resistances of the turned-ON PMOS transistor and the turned-ON NMOS transistor included in the logic circuit 9. In other words, the through current IB depends on the through current IA, that is, the constant current Io.

In other words, the PMOS transistor 2 and the NMOS transistor 3, which cause the through current IA to flow, are formed by the same manufacturing process as that of the PMOS transistor and the NMOS transistor included in the logic circuit 9, which cause the through current IB to flow. For simple description, it is assumed that each of the MOS transistors which cause the through current IA to flow has the same gate length and the same gate width as those of each of the MOS transistors which cause the through current IB to flow, and in this case, those MOS transistors have the same ON-state resistance R. Then, from Expression (2), Expressions (3) and (4) below are satisfied.

$$R\cdot IA=R\cdot Io\cdot VREF \quad (3)$$

$$R\cdot IB=DVDD=VREF-Vtn4 \quad (4)$$

From Expressions (3) and (4), the through current IB is calculated by Expression (5) below.

$$IB=IA-Vtn4/R=Io-Vtn4/R \quad (5)$$

In other words, from Expression (5), the through current IB depends on the through current IA, that is, the constant current Io. Therefore, the through current IB can be controlled by appropriate circuit design on the constant current Io.

In addition, from Expression (5) above, the through current IB does not depend on a power supply voltage VDD.

When the through current of the logic circuit 9 flows to decrease the internal power supply voltage DVDD, a gate-source voltage of the NMOS transistor 4 is increased. The ON-state resistance of the NMOS transistor 4 is accordingly reduced to increase the internal power supply voltage DVDD. In other words, the NMOS transistor 4 operates so that the internal power supply voltage DVDD may become constant.

With this configuration, the reference voltage VREF is generated based on the constant current of the current source 1 independently of the power supply voltage VDD, and, based on the reference voltage VREF, the internal power supply voltage DVDD is generated independently of the power supply voltage VDD because of the source follower. The through current of the logic circuit 9 flows based on the internal power supply voltage DVDD. As expressed by Expression (5), the through current of the logic circuit 9 is therefore independent of the power supply voltage VDD.

Further, the internal power supply voltage DVDD is a minimum power supply voltage for the logic circuit 9 to operate based on the specification. The through current of the logic circuit 9 is therefore small.

Besides, even if there are fluctuations in the threshold voltages of the MOS transistors due to manufacturing process fluctuations, the threshold voltages of the MOS transistors fluctuate to the same extent because each of the MOS transistors for generating the reference voltage VREF and each of the MOS transistors supplied with the internal power supply voltage DVDD are all formed by the same manufacturing process. Accordingly, both the constant current Io and the through current of the logic circuit 9 fluctuate to the same extent. In this case, as expressed by Expression (5), the through current of the logic circuit 9 can be controlled by appropriate circuit design on the constant current Io, independently of the manufacturing process fluctuations.

Figure 2:
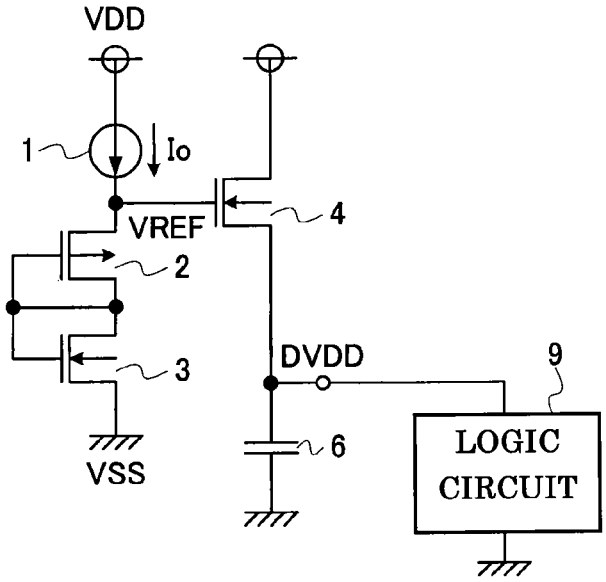
FIG. 2 is a circuit diagram illustrating another example of the internal power supply voltage generation circuit according to the present invention.

Note that, as illustrated in FIG. 2, a capacitor 6 may be additionally provided between the internal power supply terminal and the ground terminal.

This configuration makes the internal power supply voltage DVDD at the internal power supply terminal less prone to abrupt fluctuations because of the capacitor 6 and therefore stable.

Figure 3:
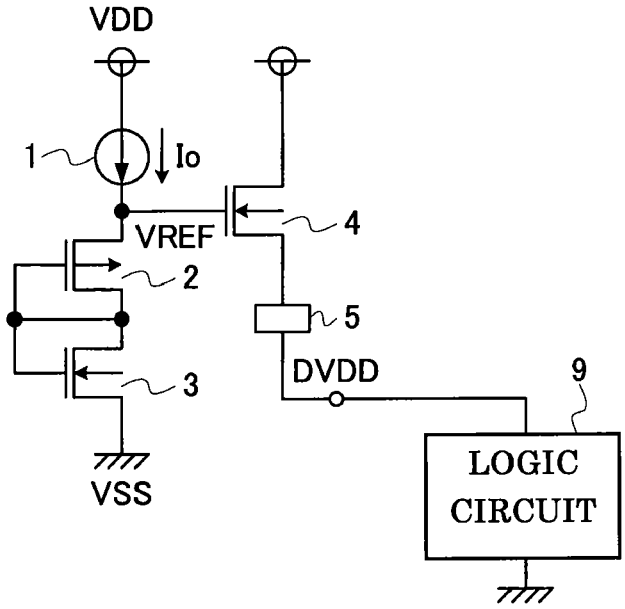
FIG. 3 is a circuit diagram illustrating a further example of the internal power supply voltage generation circuit according to the present invention.
Figure 4:
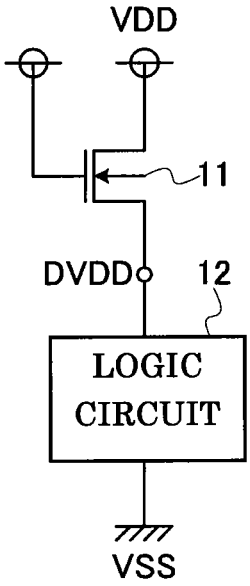
Fig. 4 PRIOR ART
FIG. 4 is a circuit diagram illustrating a conventional internal power supply voltage generation circuit.

Further, as illustrated in FIG. 3, an impedance element 5 such as a resistor or a diode may be additionally provided between the source of the NMOS transistor 4 and the internal power supply terminal.

In this circuit, it is assumed that there are fluctuations in the threshold voltage Vtn4 of the NMOS transistor 4 due to manufacturing process fluctuations and, for example, the threshold voltage Vtn4 decreases. In this case, if no impedance element 5 is provided, the internal power supply voltage DVDD increases from Expression (2). However, if the impedance element 5 is provided as illustrated in FIG. 3, the current flowing through the NMOS transistor 4 increases accompanying the decrease in the threshold voltage Vtn4, and accordingly a voltage generated by the impedance element 5 increases. This voltage produces voltage drop to prevent the internal power supply voltage DVDD from increasing. In other words, when the impedance element 5 is provided, the internal power supply voltage DVDD does not increase even if the threshold voltage Vtn4 decreases. In addition, even if the threshold voltage Vtn4 increases, similarly to the above, the internal power supply voltage DVDD does not decrease.

This configuration makes the internal power supply voltage DVDD less prone to fluctuations even if there are fluctuations in the threshold voltage Vtn4 of the NMOS transistor 4 due to manufacturing process fluctuations.

The NMOS transistor 4 may be an enhancement mode NMOS transistor formed by a different manufacturing process (such as channel doping step) from the NMOS transistor included in the logic circuit 9 so as to have a positive threshold voltage lower than the threshold voltage of the NMOS transistor included in the logic circuit 9. Alternatively, the NMOS transistor 4 may be a depletion mode NMOS transistor formed by a different manufacturing process from the NMOS transistor included in the logic circuit 9 so as to have a negative threshold voltage.

In this case, from Expression (2), the internal power supply voltage DVDD increases to increase the through current of the logic circuit 9 correspondingly, but operation speed of the logic circuit 9 becomes faster.

Further, in FIG. 1, the PMOS transistor 2 and the NMOS transistor 3 are connected in series between the current source 1 and the ground terminal in the stated order, but may be connected in series in the reversed order, though not illustrated.

What is claimed is:

1. An internal power supply voltage generation circuit for generating an internal power supply voltage at an internal power supply terminal and supplying the internal power supply voltage to a logic circuit, the internal power supply voltage generation circuit comprising:

a voltage generation circuit comprising a PMOS transistor which is diode-connected and a first NMOS transistor which is diode-connected;

a current source provided between a power supply terminal and the voltage generation circuit; and a second NMOS transistor which is source-follower-connected between the power supply terminal and the internal power supply terminal, including a gate connected to a connection node between the current source and the voltage generation circuit and supplied with a reference voltage, wherein the PMOS transistor is formed by the same manufacturing process as a manufacturing process of a PMOS transistor included in the logic circuit, and wherein the first NMOS transistor is formed by the same manufacturing process as a manufacturing process of an NMOS transistor included in the logic circuit.

2. An internal power supply voltage generation circuit according to claim 1, wherein the second NMOS transistor comprises an enhancement mode NMOS transistor having a positive threshold voltage equal to a threshold voltage of the NMOS transistor included in the logic circuit.

3. An internal power supply voltage generation circuit according to claim 1, wherein the second NMOS transistor comprises an enhancement mode NMOS transistor having a positive threshold voltage lower than a threshold voltage of the NMOS transistor included in the logic circuit.

4. An internal power supply voltage generation circuit according to claim 1, wherein the second NMOS transistor comprises a depletion mode NMOS transistor having a negative threshold voltage.

5. An internal power supply voltage generation circuit according to claim 1, further comprising a capacitor provided between the internal power supply terminal and a ground terminal.

6. An internal power supply voltage generation circuit according to claim 1, further comprising an impedance element provided between a source of the second NMOS transistor and the internal power supply terminal.

7. An internal power supply voltage generation circuit according to claim 6, wherein the second NMOS transistor comprises an enhancement mode NMOS transistor having a positive threshold voltage equal to a threshold voltage of the NMOS transistor included in the logic circuit.

8. An internal power supply voltage generation circuit according to claim 6, wherein the second NMOS transistor comprises an enhancement mode NMOS transistor having a positive threshold voltage lower than a threshold voltage of the NMOS transistor included in the logic circuit.

9. An internal power supply voltage generation circuit according to claim 6, wherein the second NMOS transistor comprises a depletion mode NMOS transistor having a negative threshold voltage.

10. An internal power supply voltage generation circuit according to claim 6, further comprising a capacitor provided between the internal power supply terminal and a ground terminal.

* * * * *